US011249500B2

(12) United States Patent
Yoo et al.

(10) Patent No.: US 11,249,500 B2
(45) Date of Patent: Feb. 15, 2022

(54) REGULATOR AND OPERATING METHOD THEREOF

(71) Applicant: IUCF-HYU (INDUSTRY-UNIVERSITY COOPERATION FOUNDATION HANYANG UNIVERSITY), Seoul (KR)

(72) Inventors: Changsik Yoo, Seoul (KR); Jin-Gyu Kang, Pyeongtaek-si (KR)

(73) Assignee: IUCF-HYU (INDUSTRY-UNIVERSITY COOPERATION FOUNDATION HANYANG UNIVERSITY), Seoul (KR)

( * ) Notice: Subject to any disclaimer, the term of this patent is extended or adjusted under 35 U.S.C. 154(b) by 86 days.

(21) Appl. No.: 16/872,621

(22) Filed: May 12, 2020

(65) Prior Publication Data

US 2021/0132643 A1 May 6, 2021

(30) Foreign Application Priority Data

Oct. 31, 2019 (KR) ..... 10-2019-0137807

(51) Int. Cl.
*G05F 1/575* (2006.01)
*G05F 1/565* (2006.01)
*G05F 1/59* (2006.01)

(52) U.S. Cl.
CPC ..... *G05F 1/575* (2013.01); *G05F 1/565* (2013.01); *G05F 1/59* (2013.01)

(58) Field of Classification Search
CPC ..... G05F 1/575; G05F 1/565; G05F 1/59
See application file for complete search history.

(56) References Cited

U.S. PATENT DOCUMENTS 8,421,663 B1 * 4/2013 Bennett ..... H03M 1/0678 341/155
9,256,267 B2 2/2016 Kawasaki
(Continued)

FOREIGN PATENT DOCUMENTS

KR 10-1198852 B1 11/2012
KR 10-1621367 B1 6/2016

OTHER PUBLICATIONS

Somnath Kundu et al., "A Fully Integrated Digital LDO with Built-In Adaptive Sampling and Active Voltage Positioning Using a Beat-Frequency Quantizer", IEEE Journal Of Solid-State Circuits, 2018, 12 pages.

(Continued)

*Primary Examiner* — Kyle J Moody
*Assistant Examiner* — Lakaisha Jackson
(74) *Attorney, Agent, or Firm* — Sughrue Mion, PLLC

(57) ABSTRACT

A regulator includes a switch array, a feedback circuit, first and second voltage-controlled oscillators, and a switch driver. The switch array generates an output voltage based on a number of enabled switches from among a plurality of switches. The feedback circuit generates a feedback voltage which depends on a level of the output voltage. The first voltage-controlled oscillator generates a first signal having a first frequency which depends on a difference between a reference voltage and the feedback voltage. The second voltage-controlled oscillator generates a second signal having a second frequency which depends on a difference between the feedback voltage and the reference voltage. The switch driver determines a turn-on time point of each of the plurality of switches based on the first signal and determining a turn-off time point of each of the plurality of switches based on the second signal.

20 Claims, 8 Drawing Sheets

(56) References Cited

U.S. PATENT DOCUMENTS

| | | | | |
|---|---|---|---|---|
| 9,423,810 | B2 | 8/2016 | Chen et al. | |
| 10,177,666 | B2 * | 1/2019 | Djenguerian | H02M 3/33523 |
| 10,224,944 | B2 | 3/2019 | Salem et al. | |
| 2016/0282889 | A1 * | 9/2016 | Mahajan | G05F 1/575 |
| 2018/0314283 | A1 * | 11/2018 | Feng | G05F 1/561 |
| 2018/0329440 | A1 * | 11/2018 | Jefremow | G05F 1/59 |
| 2019/0317536 | A1 | 10/2019 | Liu et al. | |

OTHER PUBLICATIONS

Yasuyuki Okuma et al., "0.5-V Input Digital LDO with 98.7% Current Efficiency and 2.7 μA Quiescent Current in 65nm CMOS", 2010 IEEE, 4 pages.

Arijit Raychowdhury et al., "A Fully Digital Phase-Locked Low Dropout Regulator in 32nm CMOS", Symposium on VLSI Circuits Digest of Technical Papers, 2012, 2 pages.

Samantak Gangopadhyay et al. "A 32 nm Embedded, Fully Digital, Phase-Locked Low Dropout Regulator for Fine Grained Power Management in Digital Circuits", IEEE Journal Of Solid-State Circuits, 2014, 10 pages, vol. 49, No. 11.

Somnath Kundu et al., "A Fully Integrated 40pF Output Capacitor Beat-Frequency-Quantizer-Based Digital LDO with Built-In Adaptive Sampling and Active Voltage Positioning", IEEE International Solid-State Circuits Conference, 2018, 3 pages.

Jin-Gyu Kang et al., "Time-Based Digital LDO Regualtor with Fractionally Controlled Power Transistor Strength and Fast Transient Response", Department of Electronic Engineering Hanyang University, Seoul, Korea, ASSCC 2019, 4 pages.

* cited by examiner

REGULATOR AND OPERATING METHOD THEREOF

CROSS-REFERENCE TO RELATED APPLICATIONS

This application claims priority under 35 U.S.C. § 119 to Korean Patent Application No. 10-2019-0137807 filed on Oct. 31, 2019, in the Korean Intellectual Property Office, the disclosures of which are incorporated by reference herein in their entireties.

BACKGROUND

Embodiments of the inventive concept described herein relate to a regulator and an operating method thereof, and more particularly, relate to a time-based digital low-dropout (LDO) regulator and an operating method thereof.

A regulator is used to supply a stable power to various electronic circuits (or loads). Compared to an analog regulator, a digital LDO regulator is on the spotlight in terms of the ease of a frequency compensation characteristic and the expandability of process. A conventional digital LDO regulator includes a comparator, a shift register, and a switch array for the purpose of regulating an output voltage. The comparator may compare an output voltage output from the switch array with a reference voltage. The shift register may adjust the number of turned-on switches, depending on a comparison result.

However, in the case of the conventional digital LDO regulator, because the number of turned-on switches is quantized, the accuracy of an output voltage may decrease. Also, because the conventional digital LDO regulator regulates the output voltage by using the comparator, a limit cycle oscillation phenomenon may occur, thereby causing an increase of an output ripple. Also, in the case of the conventional digital LDO regulator, because the number of turned-on switches is adjusted one by one every rising edge of a clock, a transient response speed may be slow.

SUMMARY

Embodiments of the inventive concept provide a regulator capable of improving the accuracy of an output voltage and improving a transient response speed and an operating method thereof.

A regulator according to an embodiment of the inventive concept includes a switch array, a feedback circuit, a first voltage-controlled oscillator, a second voltage-controlled oscillator, and a switch driver. The switch array includes a plurality of switches connected in parallel and generates an output voltage based on a number of enabled switches from among the plurality of switches. The feedback circuit generates a feedback voltage which depends on a level of the output voltage. The first voltage-controlled oscillator generates a first signal having a first frequency which depends on a difference between a reference voltage and the feedback voltage. The second voltage-controlled oscillator generates a second signal having a second frequency which depends on a difference between the feedback voltage and the reference voltage. The switch driver determines a turn-on time point of each of the plurality of switches based on the first signal and determining a turn-off time point of each of the plurality of switches based on the second signal.

For example, when the reference voltage is greater than the feedback voltage, the first frequency is greater than the second frequency, and the number of the enabled switches increases depending on a difference between the first frequency and the second frequency. For example, when the feedback voltage is greater than the reference voltage, the second frequency is greater than the first frequency, and the number of the enabled switches decreases depending on a difference between the second frequency and the first frequency. For example, when the reference voltage is equal to the feedback voltage, the first frequency and the second frequency are equal to a reference frequency, and the turn-on time point and the turn-off time point of each of the plurality of switches are repeated at the reference frequency.

For example the first voltage-controlled oscillator may generate the first signal including a plurality of set signals having different phases and respectively corresponding to the plurality of switches. The second voltage-controlled oscillator may generate the second signal including a plurality of reset signals having different phases and respectively corresponding to the plurality of switches. The switch driver may turn on the plurality of switches respectively at different time points based on the different phases of the plurality of set signals and may turn off the plurality of switches respectively at different time points based on the different phases of the plurality of reset signals.

For example the switch driver may turn on the plurality of switches respectively corresponding to the plurality of set signals in response to rising edges of the different phases of the plurality of set signals and may turn off the plurality of switches respectively corresponding to the plurality of reset signals in response to rising edges of the different phases of the plurality of reset signals.

The regulator further includes a transient detector deactivating the first voltage-controlled oscillator when the level of the output voltage is greater than a first voltage level and deactivating the second voltage-controlled oscillator when the level of the output voltage is smaller than a second voltage level lower than the first voltage level. For example, when the level of the output voltage is greater than the first voltage level, the first voltage-controlled oscillator may delay generation of the first signal until the level of the output voltage is smaller than the first voltage level. The number of the enabled switches may decrease while the generation of the first signal is delayed. For example, when the level of the output voltage is smaller than the second voltage level, the second voltage-controlled oscillator may delay generation of the second signal until the level of the output voltage is greater than the second voltage level. The number of the enabled switches may increase while the generation of the second signal is delayed.

A regulator according to an embodiment of the inventive concept includes a switch array, a feedback circuit, a bias generator, a first voltage-controlled oscillator, a second voltage-controlled oscillator, a switch driver, and a transient detector. The switch array includes a plurality of switches connected in parallel between an input terminal and an output terminal. The feedback circuit generates a feedback voltage which depends on a voltage level of the output terminal. The bias generator generates a first input signal based on a difference between a reference voltage and the feedback voltage and generates a second input signal based on a difference between the feedback voltage and the reference voltage. The first voltage-controlled oscillator generates a plurality of set signals having different phases and respectively corresponding to the plurality of switches, based on the first input signal. The second voltage-controlled oscillator generates a plurality of reset signals having different phases and respectively corresponding to the plurality of switches, based on the second input signal. The switch driver sequentially turns on the plurality of switches based on respective phases of the plurality of set signals and sequentially turns off the plurality of switches based on respective phases of the plurality of reset signals. The transient detector controls a transfer of the first input signal to the second voltage-controlled oscillator and a transfer of the second input signal to the second voltage-controlled oscillator, based on the voltage level of the output terminal.

For example, the bias generator may generate the first input signal of a level proportional to a difference between the reference voltage and the feedback voltage and may generate the second input signal of a level proportional to a difference between the feedback voltage and the reference voltage. For example, the first voltage-controlled oscillator may include a first ring oscillator sequentially outputting the plurality of set signals at a time interval which depends on a level of the first input signal. For example, the second voltage-controlled oscillator may include a second ring oscillator sequentially outputting the plurality of reset signals at a time interval which depends on a level of the second input signal.

For example, during a time when the reference voltage and the feedback voltage are equal, a time interval when each of the plurality of switches is enabled may be uniformly maintained, and time intervals when the plurality of switches are enabled may be equal. For example, during a time when the reference voltage is greater than the feedback voltage, a time interval when each of the plurality of switches is enabled may increase. For example, during a time when the feedback voltage is greater than the reference voltage, a time interval when each of the plurality of switches is enabled may decrease.

For example, the transient detector may include a first comparator and a second comparator. The first comparator may generate a first enable signal when the voltage level of the output terminal is smaller than a first voltage level and may generate a first disable signal when the voltage level of the output terminal is greater than the first voltage level. The second comparator may generate a second enable signal when the voltage level of the output terminal is smaller than a second voltage level lower than the first voltage level and may generate a second disable signal when the voltage level of the output terminal is smaller than the second voltage level. The first voltage-controlled oscillator may receive the first input signal based on the first enable signal. The second voltage-controlled oscillator may receive the second input signal based on the second enable signal.

For example the regulator may further include a network circuit electrically connecting the bias generator and the first voltage-controlled oscillator based on the first enable signal, electrically disconnecting the bias generator from the first voltage-controlled oscillator based on the first disable signal, electrically connecting the bias generator and the second voltage-controlled oscillator based on the second enable signal, and electrically disconnecting the bias generator from the second voltage-controlled oscillator based on the second disable signal.

An operating method of a regulator according to an embodiment of the inventive concept includes generating an output voltage based on a number of enabled switches from among a plurality of switches included in a switch array, generating a feedback voltage which depends on a level of the output voltage, generating a plurality of set signals having a first frequency, which depends on a difference between a reference voltage and the feedback voltage, and having different phases, generating a plurality of reset signals having a second frequency, which depends on a difference between the feedback voltage and the reference voltage, and having different phases, sequentially turning on the plurality of switches, depending on respective phases of the plurality of set signals, and sequentially turning off the plurality of switches, depending on respective phases of the plurality of reset signals.

When the reference voltage is greater than the feedback voltage, the first frequency may be greater than the second frequency, and a number of enabled switches from among the plurality of switches may increase depending on a difference between the first frequency and the second frequency. When the feedback voltage is greater than the reference voltage, the second frequency may be greater than the first frequency, and the number of the enabled switches may decrease depending on a difference between the second frequency and the first frequency.

The operating method may further include delaying generation of the plurality of set signals until the level of the output voltage is smaller than a first voltage level, when the level of the output voltage is greater than the first voltage level, and delaying generation of the plurality of reset signals until the level of the output voltage is greater than a second voltage level, when the level of the output voltage is smaller than the second voltage level.

BRIEF DESCRIPTION OF THE FIGURES

The above and other objects and features of the inventive concept will become apparent by describing in detail exemplary embodiments thereof with reference to the accompanying drawings.

DETAILED DESCRIPTION

Hereinafter, embodiments of the inventive concept are described in detail with reference to the accompanying drawings. In the following description, specific details such as detailed components and structures are merely provided to assist the overall understanding of the embodiments of the inventive concept. Therefore, it should be apparent to those skilled in the art that various changes and modifications of the embodiments described herein may be made without departing from the scope and spirit of the present invention. In addition, descriptions of well-known functions and structures are omitted for clarity and conciseness. The terms described below are terms defined in consideration of the functions in the inventive concept and are not limited to a specific function. The definitions of the terms should be determined based on the contents throughout the specification.

Figure 1:
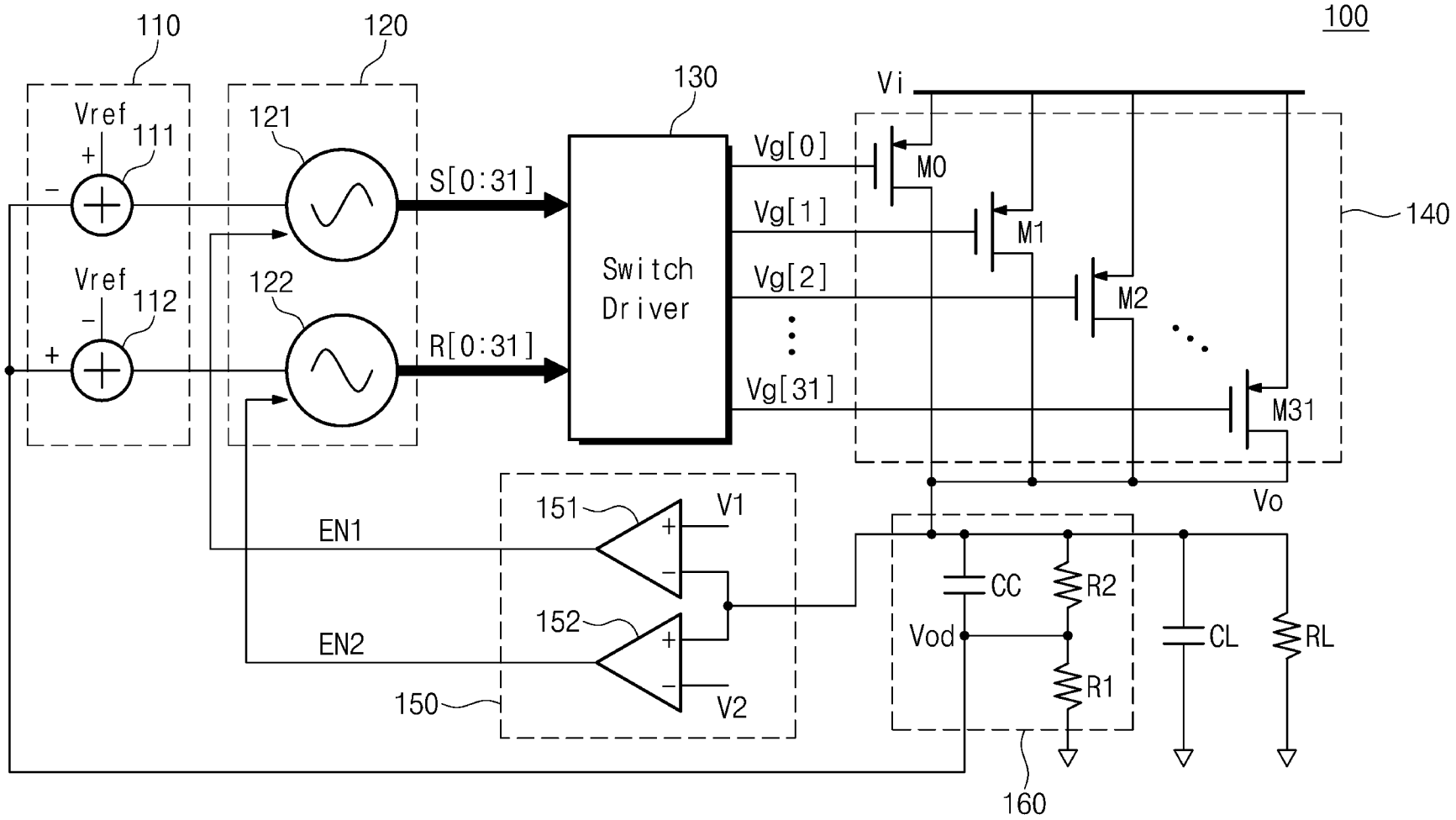
FIG. 1 is a block diagram of a regulator according to an embodiment of the inventive concept.

FIG. 1 is a block diagram of a regulator according to an embodiment of the inventive concept. A regulator 100 according to the inventive concept may be understood as a time-based digital low-dropout (LDO) regulator capable of solving the above problems. Compare to an analog regulator, the digital LDO regulator is characterized in that a space, which the digital LDO regulator occupies, of an area of a semiconductor circuit is small. Referring to FIG. 1, the regulator 100 may include a bias generator 110, a voltage-time converter 120 including a first voltage-controlled oscillator (VCO) 121 and a second voltage-controlled oscillator 122, a switch driver 130, a switch array 140, a transient detector 150, and a feedback circuit 160.

The bias generator 110 may generate an electrical signal to be input to the voltage-time converter 120, based on a feedback voltage Vod that depends on a voltage level of an output voltage Vo. The bias generator 110 may output a first input signal, which is based on a difference between a reference voltage Vref and the feedback voltage Vod, to the first voltage-controlled oscillator 121 of the voltage-time converter 120. The bias generator 110 may output a second input signal, which is based on a difference between the feedback voltage Vod and the reference voltage Vref, to the second voltage-controlled oscillator 122 of the voltage-time converter 120.

The reference voltage Vref may be understood as a voltage level of the feedback voltage Vod for generating the output voltage Vo necessary for a load. For example, the first input signal may have a current level that is proportional to a difference between the reference voltage Vref and the feedback voltage Vod. For example, the second input signal may have a current level that is proportional to a difference between the reference voltage Vref and the feedback voltage Vod.

For example, the bias generator 110 may include a first operator 111 that generates the first input signal based on a difference between the reference voltage Vref and the feedback voltage Vod and a second operator 112 that generates the second input signal based on a difference between the feedback voltage Vod and the reference voltage Vref. However, the inventive concept is not limited thereto. For example, the bias generator 110 may not be divided into the first operator 111 and the second operator 112. For example, the bias generator 110 may be implemented with a circuit structure of FIG. 6 to be described later.

The voltage-time converter 120 includes the first voltage-controlled oscillator 121 and the second voltage-controlled oscillator 122. The voltage-time converter 120 may generate an electrical signal having a frequency that is specified depending on a voltage level of the output voltage Vo. The regulator 100 may control the switch array 140 by using a pair of voltage-controlled oscillators.

The first voltage-controlled oscillator 121 may generate a first signal S[0:31] based on the first input signal. The first input signal may have a level that depends on a difference between the reference voltage Vref and the feedback voltage Vod. The first signal S[0:31] may include a plurality of set signals S[0] to S[31] having a first frequency. The plurality of set signals S[0] to S[31] may have different phases. Each of the plurality of set signals S[0] to S[31] is used to determine a turn-on time point of each of switches M0 to M31 included in the switch array 140. A magnitude of the first frequency may be proportional to a level of the first input signal. That is, as a difference between the reference voltage Vref and the feedback voltage Vod increases, the first frequency may increase.

The second voltage-controlled oscillator 122 may generate a second signal R[0:31] based on the second input signal. The second input signal may have a level that depends on a difference between the feedback voltage Vod and the reference voltage Vref. The second signal R[0:31] may include a plurality of reset signals R[0] to R[31] having a second frequency. The plurality of reset signals R[0] to R[31] may have different phases. Each of the plurality of reset signals R[0] to R[31] is used to determine a turn-off time point of each of the switches M0 to M31 included in the switch array 140. A magnitude of the second frequency may be proportional to a level of the second input signal. That is, as a difference between the feedback voltage Vod and the reference voltage Vref increases, the second frequency may increase.

The switch driver 130 may generate gate driving signals Vg[0] to Vg[31] for controlling turn-on time points and turn-off time points of the switches M0 to M31 included in the switch array 140, respectively. The switch driver 130 may sequentially turn on the plurality of switches M0 to M31 based on the plurality of set signals S[0] to S[31]. The switch driver 130 may sequentially turn off the plurality of switches M0 to M31 based on the plurality of reset signals R[0] to R[31]. A turn-on time point of each of the plurality of switches M0 to M31 may depend on the first frequency, and a turn-off time point of each of the plurality of switches M0 to M31 may depend on the second frequency.

For example, when the reference voltage Vref is greater than the feedback voltage Vod, the first frequency being a frequency of each of the plurality of set signals S[0] to S[31] may be greater than the second frequency being a frequency of each of the plurality of reset signals R[0] to R[31]. As a result, turn-off time points of the plurality of switches M0 to M31 may become slow with respect to turn-on time points of the plurality of switches M0 to M31, and the number of enabled switches may increase. As such, a level of the output voltage Vo may increase until the feedback voltage Vod increases as much as the reference voltage Vref.

For example, when the feedback voltage Vod is greater than the reference voltage Vref, the second frequency being a frequency of each of the plurality of reset signals R[0] to R[31] may be greater than the first frequency being a frequency of each of the plurality of set signals S[0] to S[31]. As a result, turn-off time points of the plurality of switches M0 to M31 may become fast with respect to turn-on time points of the plurality of switches M0 to M31, and the number of enabled switches may decrease. As such, a level of the output voltage Vo may decrease until the feedback voltage Vod decreases as much as the reference voltage Vref.

When the feedback voltage Vod is equal to the reference voltage Vref, the first frequency and the second frequency may be equal to a reference frequency. As a result, turn-on and turn-off time points of the plurality of switches M0 to M31 may be repeated at the reference frequency, and the number of enabled switches may be uniformly maintained. As such, the level of the output voltage Vo may be uniformly maintained.

The switch array 140 includes the plurality of switches M0 to M31 connected in parallel between an input terminal and an output terminal. A voltage level of the input terminal is defined as an input voltage Vi, and a voltage level of the output terminal is defined as the output voltage Vo. Each of the plurality of switches M0 to M31 may include a first terminal connected with the input terminal, a second terminal connected with the output terminal, and a gate terminal connected with the switch driver 130 to receive the corresponding one of the gate driving signals Vg[0] to Vg[31]. The output voltage Vo may be regulated depending on the number of switches being turned on from among the plurality of switches M0 to M31.

The output voltage Vo is provided to a load. The output voltage Vo may fluctuate based on a load impedance capable of being expressed by a load capacitor CL and a load resistor RL. As described above, the output voltage Vo may be regulated depending on the number of enabled switches in the switch array 140. Accordingly, the stable output voltage Vo may be provided to the load.

The transient detector 150 may control activation or deactivation of the first and second voltage-controlled oscillators 121 and 122 for the purpose of reaching a normal state quickly when a level of the output voltage Vo is out of a reference range. Here, the reference range may include an upper limit and a lower limit for identifying the case where the output voltage Vo fluctuates, to such an extent as to cause an abnormal operation of the regulator 100. The upper limit of the reference range may be defined as a first voltage V1, and the lower limit of the reference range may be defined as a second voltage V2. To this end, the transient detector 150 may include a first comparator 151 and a second comparator 152.

The first comparator 151 may compare the output voltage Vo and the first voltage V1. The first comparator 151 may generate a first enable signal EN1 depending on a result of comparing the output voltage Vo and the first voltage V1. When a level of the output voltage Vo is greater than a level of the first voltage V1, the first comparator 151 may generate the first enable signal EN1 (or a first disable signal) for deactivating the first voltage-controlled oscillator 121. As a result, the first voltage-controlled oscillator 121 may not generate the first signal S[0:31] until the level of the output voltage Vo becomes smaller than the level of the first voltage V1. As such, the number of enabled switches may decrease until the level of the output voltage Vo becomes smaller than the level of the first voltage V1.

The second comparator 152 may compare the output voltage Vo and the second voltage V2. The second comparator 152 may generate a second enable signal EN2 depending on a result of comparing the output voltage Vo and the second voltage V2. When a level of the output voltage Vo is smaller than a level of the second voltage V2, the second comparator 152 may generate the second enable signal EN2 (or a second disable signal) for deactivating the second voltage-controlled oscillator 122. As a result, the second voltage-controlled oscillator 122 may not generate the second signal R[0:31] until the level of the output voltage Vo becomes greater than the level of the second voltage V2. As such, the number of enabled switches may increase until the level of the output voltage Vo becomes greater than the level of the second voltage V2.

When the output voltage Vo is within the reference range, the first comparator 151 may generate the first enable signal EN1 for a normal operation of the first voltage-controlled oscillator 121 and may generate the second enable signal EN2 for a normal operation of the second voltage-controlled oscillator 122. That is, when the output voltage Vo is out of the reference range, the transient detector 150 may control operations of the first voltage-controlled oscillator 121 and the second voltage-controlled oscillator 122 such that the number of enabled switches are quickly adjusted. As such, a response speed in a transient response state may be improved.

The feedback circuit 160 may generate the feedback voltage Vod that depends on a level of the output voltage Vo. For example, the feedback circuit 160 may include a first resistor R1 and a second resistor R2 for dividing the output voltage Vo. The first resistor R1 and the second resistor R2 may be connected in series between the output terminal and a ground. The feedback voltage Vod generated from a node between the first resistor R1 and the second resistor R2 may be provided to the bias generator 110. The feedback circuit 160 may further include a capacitor CC for securing the stability of a feedback loop. For example, the capacitor CC may generate a zero for securing the stability of the feedback loop having poles generated by the load capacitor CL and the first and second voltage-controlled oscillators 121 and 122.

FIGS. 2 to 5 are graphs for describing an operation in which a regulator of FIG. 1 determines the number of enabled switches. FIGS. 2 to 5 are diagrams for describing the number of enabled switches in a normal state. In a normal state, the feedback voltage Vod of FIG. 1 may be equal to the reference voltage Vref, and the frequency (or the first frequency) of each of the plurality of set signals S[0] to S[31] and the frequency (or the second frequency) of each of the plurality of reset signals R[0] to R[31] may be the reference frequency. A reference time interval TT may be understood as a cycle of the plurality of set signals S[0] to S[31] and the plurality of reset signals R[0] to R[31] and may be determined depending on the reference frequency.

Each of the plurality of set signals S[0] to S[31] and the plurality of reset signals R[0] to R[31] may have a rising edge that is repeated depending on the reference frequency. The plurality of set signals S[0] to S[31] may have different phases and may be output from the first voltage-controlled oscillator 121. The plurality of set signals S[0] to S[31] may be sequentially output with a delay time of $2\pi/32$ being $1/32$ of the reference time interval TT. Likewise, the plurality of reset signals R[0] to R[31] may have different phases and may be output from the second voltage-controlled oscillator 122. The plurality of reset signals R[0] to R[31] may be sequentially output with the delay time of $2\pi/32$ being $1/32$ of the reference time interval TT.

Figure 2:
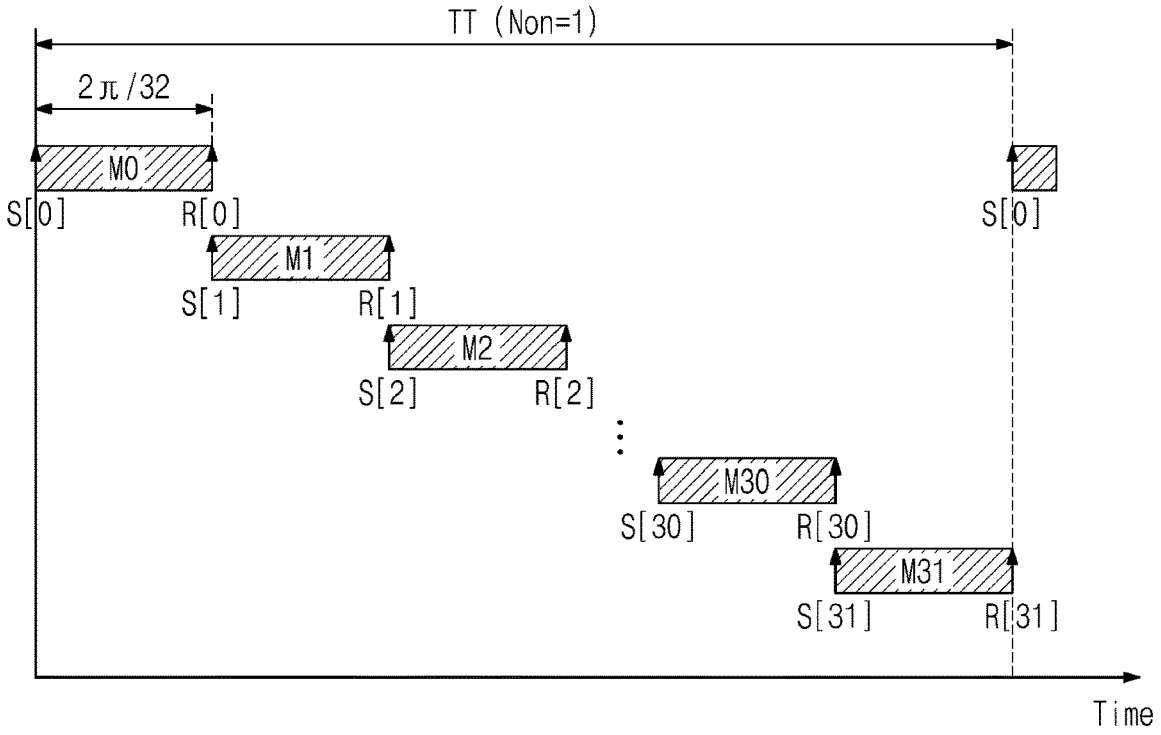
FIGS. 2 to 5 are graphs for describing an operation in which a regulator of FIG. 1 determines the number of enabled switches.

Referring to FIG. 2, the plurality of set signals S[0] to S[31] and the plurality of reset signals R[0] to R[31] associated with the case where the number of enabled switches is "1" during the reference time interval TT are illustrated. A phase difference between each of the plurality of set signals S[0] to S[31] output from the first voltage-controlled oscillator 121 and each of the plurality of reset signals R[0] to R[31] output from the second voltage-controlled oscillator 122 may be $2\pi/32$. For example, a difference between a rising edge of the 0-th set signal S[0] and a rising edge of the 0-th reset signal R[0] may be $2\pi/32$. As a result, a time interval when each of the switches M0 to M31 is enabled may be $1/32$ of the reference time interval TT. For example, the rising edge of the 0-th reset signal R[0] and the rising edge of the first set signal S[1] may overlap each other. The switches M0 to M31 may be sequentially turned on and turned off one by one during the reference time interval TT.

Figure 3:
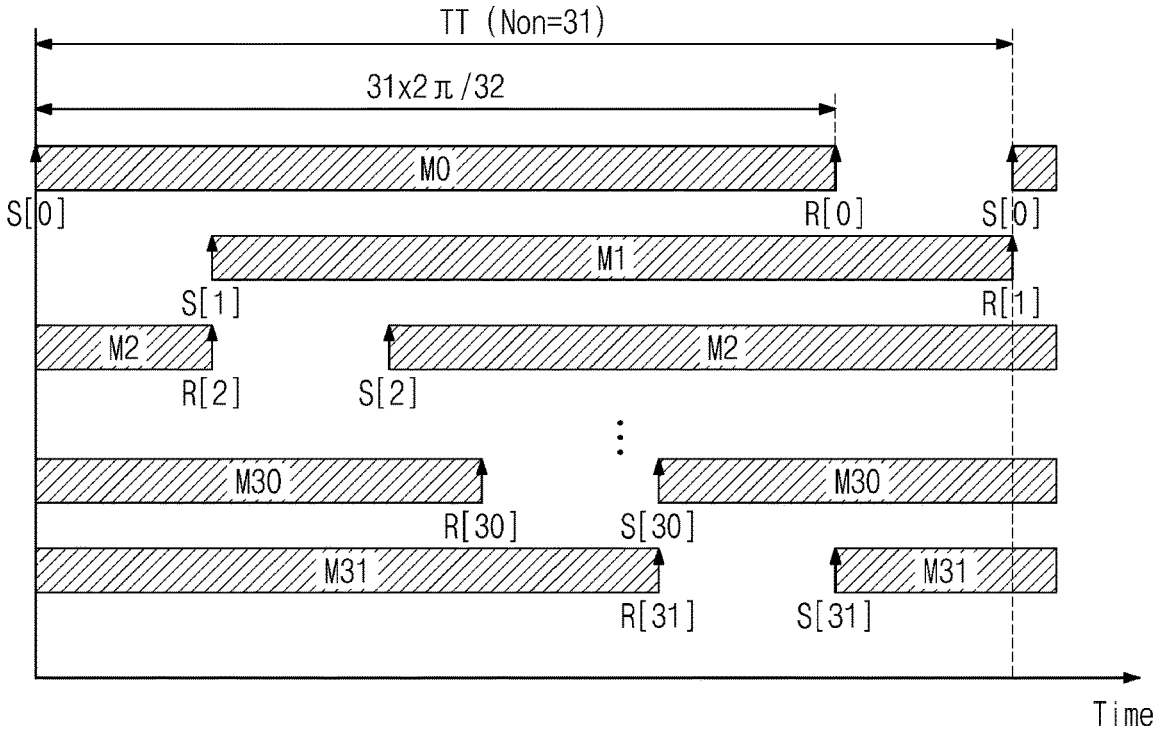

Referring to FIG. 3, the plurality of set signals S[0] to S[31] and the plurality of reset signals R[0] to R[31] associated with the case where the number of turned-on switches is "31" during the reference time interval TT are illustrated. A phase difference between each of the plurality of set signals S[0] to S[31] output from the first voltage-controlled oscillator 121 and each of the plurality of reset signals R[0] to R[31] output from the second voltage-controlled oscillator 122 may be $(31\times2\pi)/32$. For example, a difference between the rising edge of the 0-th set signal S[0] and the rising edge of the 0-th reset signal R[0] may be $(31\times2\pi)/32$. As a result, a time interval when each of the switches M0 to M31 is enabled may be $31/32$ of the reference time interval TT. For example, the rising edge of the 0-th reset signal R[0] and the rising edge of the 31th set signal S[31] may overlap each other.

During the 0-th switch M0 is enabled, the first to 30th switches M1 to M30 may be sequentially turned on; the 31th switch M31 may be turned on when the 0-th switch M0 is turned off. During the reference time interval TT, the turned-on switches may be repeatedly changed, but the number of enabled switches may be 31. For example, the enabled switches between the rising edge of the 0-th set signal S[0] and the rising edge of the first set signal S[1] may be the 0-th switch M0 and the second to 31th switches M2 to M31.

Figure 4:
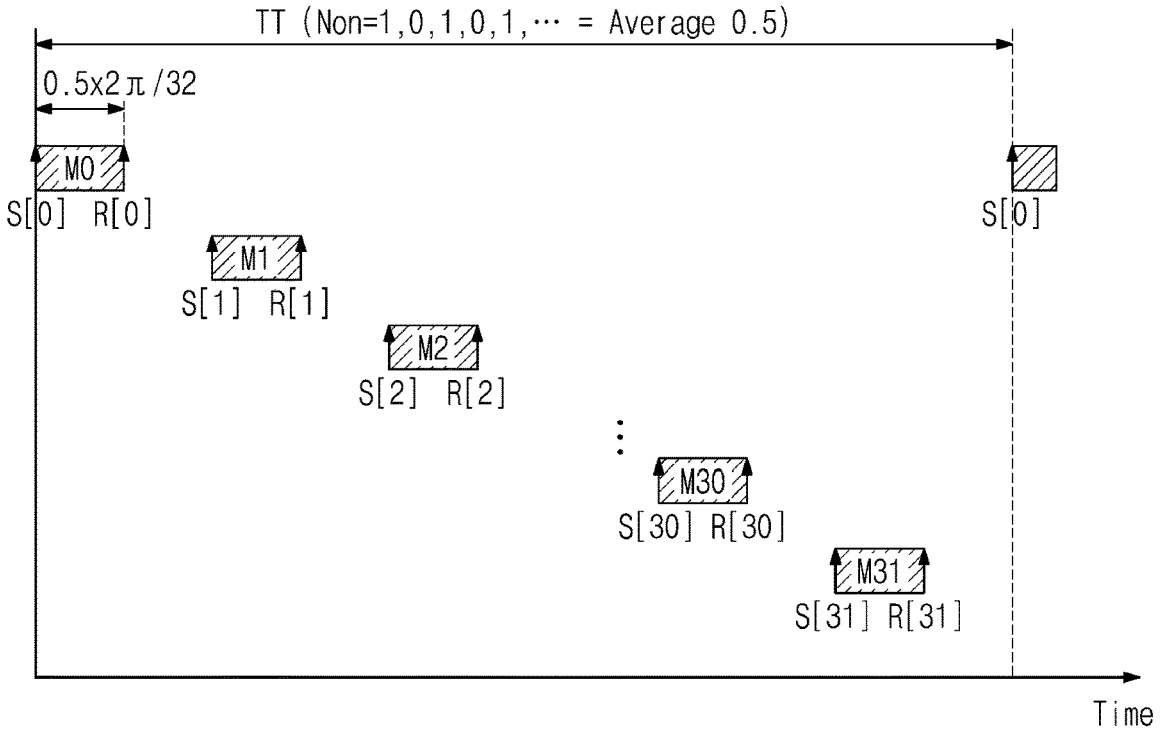

Referring to FIG. 4, the plurality of set signals S[0] to S[31] and the plurality of reset signals R[0] to R[31] associated with the case where the number of enabled switches is an average of "0.5" during the reference time interval TT are illustrated. A phase difference between each of the plurality of set signals S[0] to S[31] output from the first voltage-controlled oscillator 121 and each of the plurality of reset signals R[0] to R[31] output from the second voltage-controlled oscillator 122 may be $(0.5\times2\pi)/32$. For example, a difference between the rising edge of the 0-th set signal S[0] and the rising edge of the 0-th reset signal R[0] may be $(0.5\times2\pi)/32$. As a result, a time interval when each of the switches M0 to M31 is enabled may be 1/64 of the reference time interval TT.

The number of switches enabled between the rising edge of the 0-th set signal S[0] and the rising edge of the 0-th reset signal R[0] may be "1", and the number of switches enabled between the rising edge of the 0-th reset signal R[0] and the rising edge of the first set signal S[1] may be "0". As a result, during the reference time interval TT, the number of enabled switches may be repeated like "1", "0", "1", "0", etc. During the reference time interval TT, averagely, the number of enabled switches may be "0.5". That is, in the regulator 100, the number of enabled switches may not be quantized and may be continuously adjusted.

Figure 5:
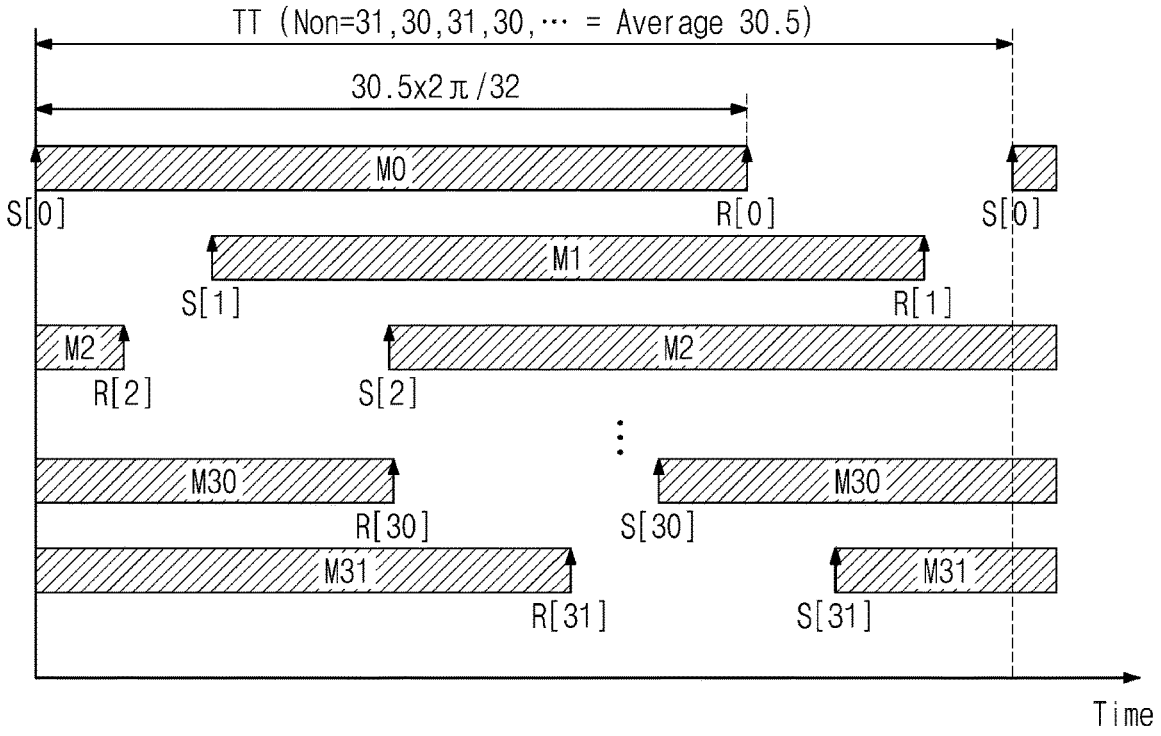

Referring to FIG. 5, the plurality of set signals S[0] to S[31] and the plurality of reset signals R[0] to R[31] associated with the case where the number of enabled switches is an average of "30.5" during the reference time interval TT are illustrated in FIG. 5. A phase difference between each of the plurality of set signals S[0] to S[31] output from the first voltage-controlled oscillator 121 and each of the plurality of reset signals R[0] to R[31] output from the second voltage-controlled oscillator 122 may be $(30.5\times2\pi)/32$. For example, a difference between the rising edge of the 0-th set signal S[0] and the rising edge of the 0-th reset signal R[0] may be $(30.5\times2\pi)/32$. As a result, a time interval when each of the switches M0 to M31 is enabled may be 61/64 of the reference time interval TT.

During the 0-th switch M0 is enabled, the first to 30th switches M1 to M30 may be sequentially turned on; the 31th switch M31 may be turned on after the 0-th switch M0 is turned off. The number of enabled switches between the rising edge of the 0-th set signal S[0] and the rising edge of the second reset signal R[2] may be "31" (i.e., the 0-th switch M0 and the second to 31th switches M2 to M31), and the number of enabled switches between the rising edge of the second reset signal R[2] and the rising edge of the first set signal S[1] may be "30" (i.e., the 0-th switch M0 and the third to 31th switches M3 to M31). As a result, during the reference time interval TT, the number of enabled switches may be repeated like "31", "30", "31", "30", etc. During the reference time interval TT, averagely, the number of enabled switches may be "30.5". That is, in the regulator 100, the number of enabled switches may not be quantized and may be continuously adjusted.

Referring to FIGS. 2 to 5, during the reference time interval TT, switches may be enabled in various numbers without quantization. The number of enabled switches within the reference time interval TT may not be limited to an integer, by adjusting a delay time between a rising edge of a set signal and a rising edge of a reset signal. Accordingly, the accuracy of the output voltage Vo may be improved. Also, because a change in the number of enabled switches within the reference time interval TT of a normal state is "0" or "1", a ripple of the output voltage Vo may be small.

As described above, when the feedback voltage Vod is smaller than the reference voltage Vref, the first frequency being the frequency of each of the plurality of set signals S[0] to S[31] may be greater than the second frequency being the frequency of each of the plurality of reset signals R[0] to R[31]. In this case, until reaching the normal state operations illustrated in FIGS. 2 to 5, time points when rising edges of the set signals S[0] to S[31] are sequentially generated may become fast, or time points when rising edges of the reset signals R[0] to R[31] are sequentially generated may become slow. As a result, the number of enabled switches may increase during the reference time interval TT. As such, the output voltage Vo may increase until the feedback voltage Vod satisfies the reference voltage Vref.

As described above, when the feedback voltage Vod is greater than the reference voltage Vref, the first frequency being the frequency of each of the plurality of set signals S[0] to S[31] may be smaller than the second frequency being the frequency of each of the plurality of reset signals R[0] to R[31]. In this case, until reaching the normal state operations illustrated in FIGS. 2 to 5, time points when rising edges of the set signals S[0] to S[31] are sequentially generated may become slow, or time points when rising edges of the reset signals R[0] to R[31] are sequentially generated may become fast. As a result, the number of enabled switches may decrease during the reference time interval TT. As such, the output voltage Vo may decrease until the feedback voltage Vod satisfies the reference voltage Vref.

Figure 6:
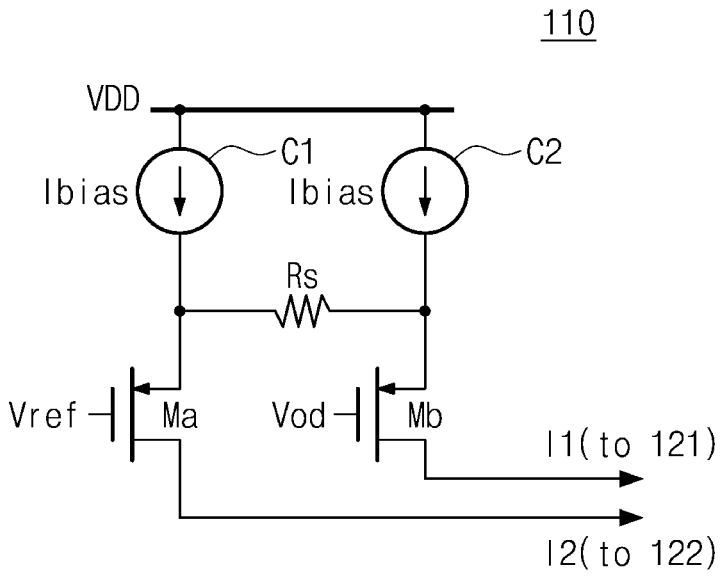
FIG. 6 is an exemplary circuit diagram of a bias generator of FIG. 1.

FIG. 6 is an exemplary circuit diagram of a bias generator of FIG. 1. FIG. 6 may be understood as an exemplary circuit diagram for generating first and second input signals I1 and I2 to be provided to the voltage-time converter 120 of FIG. 1. The bias generator 110 of FIG. 1 may not be limited to a structure of FIG. 6 and may be implemented with various circuit structures capable of providing a difference between the feedback voltage Vod and the reference voltage Vref or a difference between the reference voltage Vref and the feedback voltage Vod to the voltage-time converter 120. Referring to FIG. 6, the bias generator 110 may include first and second current sources C1 and C2, a resistor Rs, and first and second transistors Ma and Mb.

Each of the first and second current sources C1 and C2 may have a first terminal receiving a power supply voltage VDD and a second terminal connected with the resistor Rs. Each of the first and second current sources C1 and C2 may output a bias current Ibias. The resistor Rs may be connected between the second terminal of the first current source C1 and the second terminal of the second current source C2. The first transistor Ma may output the second input signal I2 to the second voltage-controlled oscillator 122 based on the reference voltage Vref. The second transistor Mb may output the first input signal I1 to the first voltage-controlled oscillator 121 based on the feedback voltage Vod.

A level of the first input signal I1 may depend on a difference between the reference voltage Vref and the feedback voltage Vod. A level of the second input signal I2 may depend on a difference between the feedback voltage Vod and the reference voltage Vref. For example, when the reference voltage Vref is greater than the feedback voltage Vod, the bias currents Ibias output from the first and second current sources C1 and C2 may flow to the second transistor Mb more largely than to the first transistor Ma, and a level of the first input signal I1 may be greater than a level of the second input signal I2. In contrast, when the reference voltage Vref is smaller than the feedback voltage Vod, the bias currents Ibias output from the first and second current sources C1 and C2 may flow to the first transistor Ma more largely than to the second transistor Mb, and a level of the second input signal I2 may be greater than a level of the first input signal I1.

Figure 7:
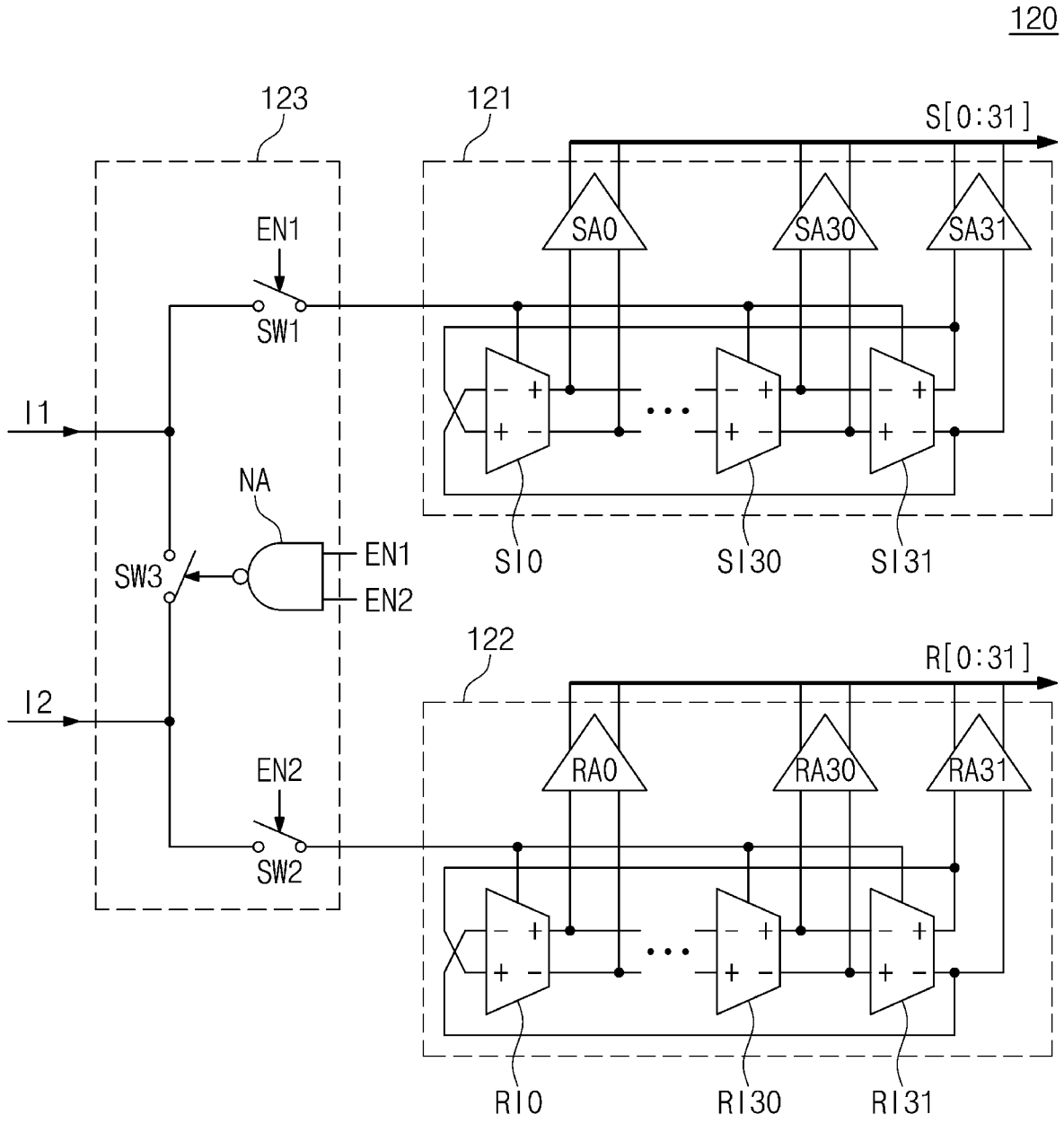
FIG. 7 is an exemplary circuit diagram of a voltage-time converter of FIG. 1.

FIG. 7 is an exemplary circuit diagram of a voltage-time converter of FIG. 1. FIG. 7 may be understood as an exemplary circuit diagram for generating the first signal S[0:31] and the second signal R[0:31] of FIG. 1. The voltage-time converter 120 of FIG. 1 may not be limited to a structure of FIG. 7 and may be implemented with various circuit structures capable of applying levels of the first and second input signals I1 and I2 to a time domain. Referring to FIG. 7, the voltage-time converter 120 may include the first voltage-controlled oscillator 121, the second voltage-controlled oscillator 122, and a network circuit 123.

The first voltage-controlled oscillator 121 may correspond to the first voltage-controlled oscillator 121 of FIG. 1 and may be implemented with a differential ring oscillator. For example, the first voltage-controlled oscillator 121 may include a plurality of delay elements SI0 to SI31 and a plurality of differential amplifiers SA0 to SA31 for implementing a ring oscillator. The first voltage-controlled oscillator 121 may generate the first signal S[0:31] based on the first input signal I1. The first signal S[0:31] may include the plurality of set signals S[0] to S[31].

Each of the plurality of delay elements SI0 to SI31 may have a delay time proportional to a level of the first input signal I1, and differential signals may be sequentially output from the plurality of delay elements SI0 to SI31. Each of the differential amplifiers SA0 to SA31 may amplify and output the corresponding one of the differential signals sequentially output. The differential amplifiers SA0 to SA31 may sequentially output set signals each having a rising edge. As a result, rising edges of the plurality of set signals S[0] to S[31] may be sequentially output with a phase difference corresponding to the delay time. For example, the 30th set signal S[30] may be output through the 30th delay element SI30 and the 30th differential amplifier SA30, and after the delay time, the 31th set signal S[31] may be output through the 31th delay element SI31 and the 31th differential amplifier SA31. A frequency of each of the plurality of set signals S[0] to S[31] may be proportional to a level of the first input signal I1.

The second voltage-controlled oscillator 122 may correspond to the second voltage-controlled oscillator 122 of FIG. 1 and may be implemented with a differential ring oscillator. For example, the second voltage-controlled oscillator 122 may include a plurality of delay elements RI0 to RI31 and a plurality of differential amplifiers RA0 to RA31 for implementing a ring oscillator. The second voltage-controlled oscillator 122 may generate the second signal R[0:31] based on the second input signal I2. The second signal R[0:31] may include the plurality of reset signals R[0] to R[31].

Each of the plurality of delay elements RI0 to RI31 may have a delay time proportional to a level of the second input signal I2, and differential signals may be sequentially output from the plurality of delay elements RI0 to RI31. Each of the differential amplifiers RA0 to RA31 may amplify and output the corresponding one of the differential signals sequentially output. The differential amplifiers RA0 to RA31 may sequentially output reset signals each having a rising edge. As a result, rising edges of the plurality of reset signals R[0] to R[31] may be sequentially output with a phase difference corresponding to the delay time. A frequency of each of the plurality of reset signals R[0] to R[31] may be proportional to a level of the second input signal I2.

The network circuit 123 may output or may not output the first and second input signals I1 and I2 to the first and second voltage-controlled oscillators 121 and 122, based on the first and second enable signals EN1 and EN2 output from the transient detector 150 of FIG. 1. When the output voltage Vo is out of the reference range, the network circuit 123 may be implemented to delay an operation of the first voltage-controlled oscillator 121 or the second voltage-controlled oscillator 122 for the purpose of quickly adjusting a turn-on or turn-off of the switches M0 to M31. To this end, the network circuit 123 may include first to third output control switches SW1 to SW3 and a NAND gate NA.

The first output control switch SW1 transfers the first input signal I1 to the first voltage-controlled oscillator 121, based on the first enable signal EN1. In FIG. 1, when a level of the output voltage Vo is smaller than a level of the first voltage V1 being the upper limit of the reference range, the first enable signal EN1 generated from the first comparator 151 may turn on the first output control switch SW1. The first output control switch SW1 may electrically connect the bias generator 110 and the first voltage-controlled oscillator 121. As such, the first voltage-controlled oscillator 121 may generate the first signal S[0:31] based on the first input signal I1.

In contrast, when the level of the output voltage Vo is smaller than the level of the first voltage V1, the first enable signal EN1 (or the first disable signal) may turn off the first output control switch SW1. The first output control switch SW1 may electrically disconnect the bias generator 110 from the first voltage-controlled oscillator 121. As such, the generation of the first signal S[0:31] is delayed until the level of the output voltage Vo becomes smaller than the level of the first voltage V1. Accordingly, in the switch array 140, the number of enabled switches decreases.

The second output control switch SW2 transfers the second input signal I2 to the second voltage-controlled oscillator 122, based on the second enable signal EN2. In FIG. 1, when a level of the output voltage Vo is smaller than a level of the second voltage V2 being the lower limit of the reference range, the second enable signal EN2 generated from the second comparator 152 may turn on the second output control switch SW2. The second output control switch SW2 may electrically connect the bias generator 110 and the second voltage-controlled oscillator 122. As such, the second voltage-controlled oscillator 122 may generate the second signal R[0:31] based on the second input signal I2.

In contrast, when the level of the output voltage Vo is smaller than the level of the second voltage V2, the second enable signal EN2 (or the second disable signal) may turn off the second output control switch SW2. The second output control switch SW2 may electrically disconnect the bias generator 110 from the second voltage-controlled oscillator 122. As such, the generation of the second signal R[0:31] is delayed until the level of the output voltage Vo becomes smaller than the level of the second voltage V2. Accordingly, the number of enabled switches in the switch array 140 increases.

The third output control switch SW3 may electrically connect or disconnect a receiving node of the first input signal I1 and a receiving node of the second input signal I2, based on a result of performing a NAND operation on the first enable signal EN1 and the second enable signal EN2. The NAND gate NA may perform the NAND operation on the first enable signal EN1 and the second enable signal EN2. For example, in the case of a normal mode where the output voltage Vo is within the reference range, the result of the NAND operation may be "0", and the third output control switch SW3 may be turned off. As a result, the first input signal I1 is transferred to the first voltage-controlled oscillator 121 through the first output control switch SW1, and the second input signal I2 is transferred to the second voltage-controlled oscillator 122 through the second output control switch SW2.

For example, in the case where a level of the output voltage Vo is greater than a level of the first voltage V1, the result of the NAND operation may be "1", and the third output control switch SW3 may be turned on. The first output control switch SW1 may be turned off, and the second output control switch SW2 may be turned on. In this case, both the first input signal I1 and the second input signal I2 may be transferred to the second voltage-controlled oscillator 122 through the second output control switch SW2. As a result, the generation of the first signal S[0:31] may be delayed, and the second signal R[0:31] may be generated at a higher frequency (than when generated by the second input signal I2), based on a sum of the first and second input signals I1 and I2. Accordingly, in the switch array 140, an additional turn-on of the switches M0 to M31 is delayed, and a turn-off of the switches M0 to M31 sharply increases. A level of the output voltage Vo may sharply decrease and may be quickly set within the reference range.

For example, in the case where a level of the output voltage Vo is smaller than a level of the second voltage V2, the result of the NAND operation may be "1", and the third output control switch SW3 may be turned on. The first output control switch SW1 may be turned on, and the second output control switch SW2 may be turned off. In this case, both the first input signal I1 and the second input signal I2 may be transferred to the first voltage-controlled oscillator 121 through the first output control switch SW1. As a result, the generation of the second signal R[0:31] may be delayed, and the first signal S[0:31] may be generated at a higher frequency (than when generated by the first input signal I1), based on a sum of the first and second input signals I1 and I2. Accordingly, in the switch array 140, an additional turn-off of the switches M0 to M31 is delayed, and a turn-on of the switches M0 to M31 sharply increases. A level of the output voltage Vo may sharply increase and may be quickly set within the reference range.

Figure 8:
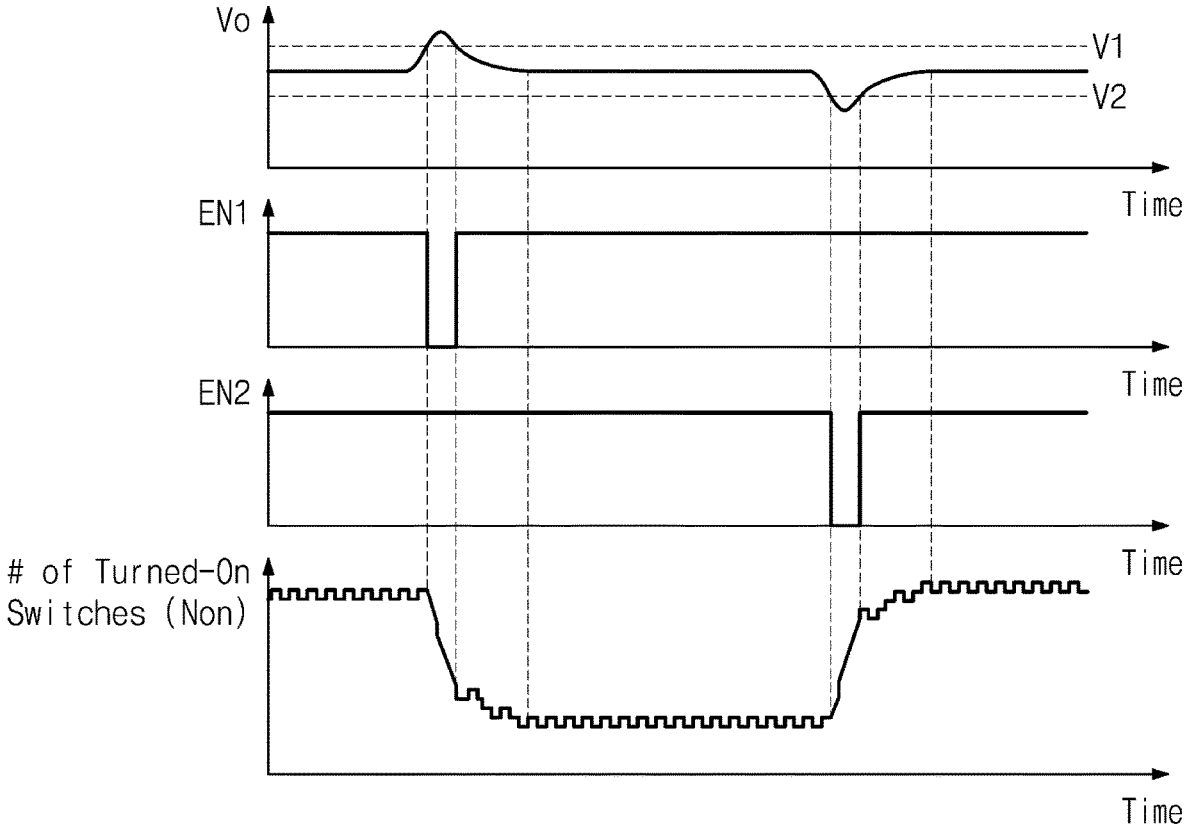
FIG. 8 is a graph for describing how a transient detector of FIG. 1 determines the number of enabled switches.

FIG. 8 is a graph for describing how a transient detector of FIG. 1 determines the number of enabled switches. Referring to FIG. 8, a horizontal axis is defined as a time, a vertical axis is defined as a level of the output voltage Vo, a level of the first enable signal EN1, a level of the second enable signal EN2, and the number Non of turned-on switches.

As described above, the transient detector 150 of FIG. 1 may determine whether the output voltage Vo is within the reference range defined by the first voltage V1 and the second voltage V2. When the output voltage Vo is within the reference range, the transient detector 150 may generate the first and second enable signals EN1 and EN2 such that the first and second input signals I1 and I2 are output to the first and second voltage-controlled oscillators 121 and 122.

When the output voltage Vo is greater than the first voltage V1, the first enable signal EN1 may have a low level. In this case, in FIG. 7, the first output control switch SW1 may be turned off, the second output control switch SW2 may be turned on, and the third output control switch SW3 may be turned on. As a result, the generation of the first signal S[0:31] may be delayed, and the second signal R[0:31] may be generated based on a sum of the first and second input signals I1 and I2. Accordingly, in the switch array 140, the number Non of enabled switches may sharply decrease.

After the output voltage Vo becomes smaller than the first voltage V1, the first enable signal EN1 may have a high level. In this case, in FIG. 7, the first output control switch SW1 may be turned on, the second output control switch SW2 may be turned on, and the third output control switch SW3 may be turned off. As a result, the first signal S[0:31] may be generated based on the first input signal I1, and the second signal R[0:31] may be generated based on the second input signal I2. Until the feedback voltage Vod satisfies the reference voltage Vref, the decrease of the output voltage Vo may be required, and the number Non of enabled switches may decrease. This operation may be performed through the feedback loop described with reference to FIG. 1.

When the output voltage Vo is smaller than the second voltage V2, the second enable signal EN2 may have a low level. In this case, in FIG. 7, the first output control switch SW1 may be turned on, the second output control switch SW2 may be turned off, and the third output control switch SW3 may be turned on. As a result, the generation of the second signal R[0:31] may be delayed, and the first signal S[0:31] may be generated based on a sum of the first and second input signals I1 and I2. Accordingly, in the switch array 140, the number Non of enabled switches may sharply increase.

After the output voltage Vo becomes greater than the second voltage V2, the second enable signal EN2 may have a high level. In this case, in FIG. 7, the first output control switch SW1 may be turned on, the second output control switch SW2 may be turned on, and the third output control switch SW3 may be turned off. As a result, the first signal S[0:31] may be generated based on the first input signal I1, and the second signal R[0:31] may be generated based on the second input signal I2. Until the feedback voltage Vod satisfies the reference voltage Vref, the increase of the output voltage Vo may be required, and the number Non of enabled switches may increase. This operation may be performed through the feedback loop described with reference to FIG. 1.

Figure 9:
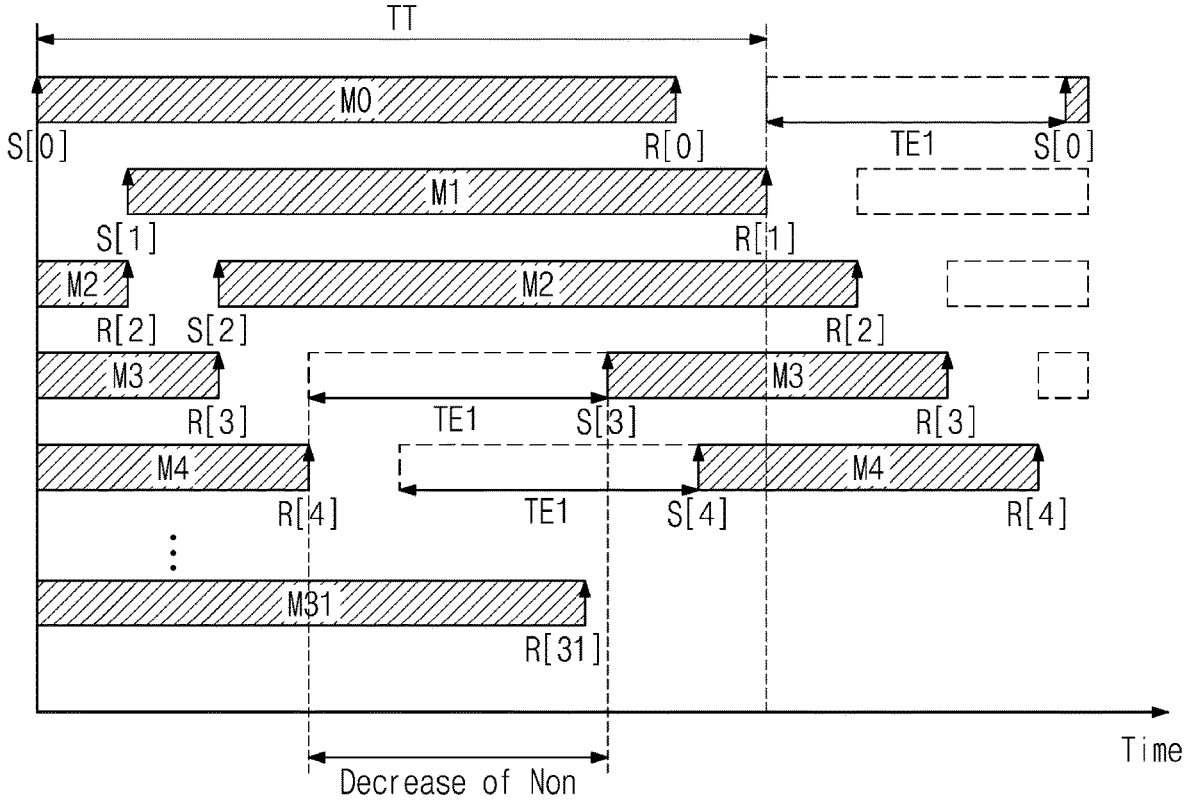
FIGS. 9 and 10 are graphs for describing how a transient detector of FIG. 1 adjusts the number of enabled switches.
Figure 10:
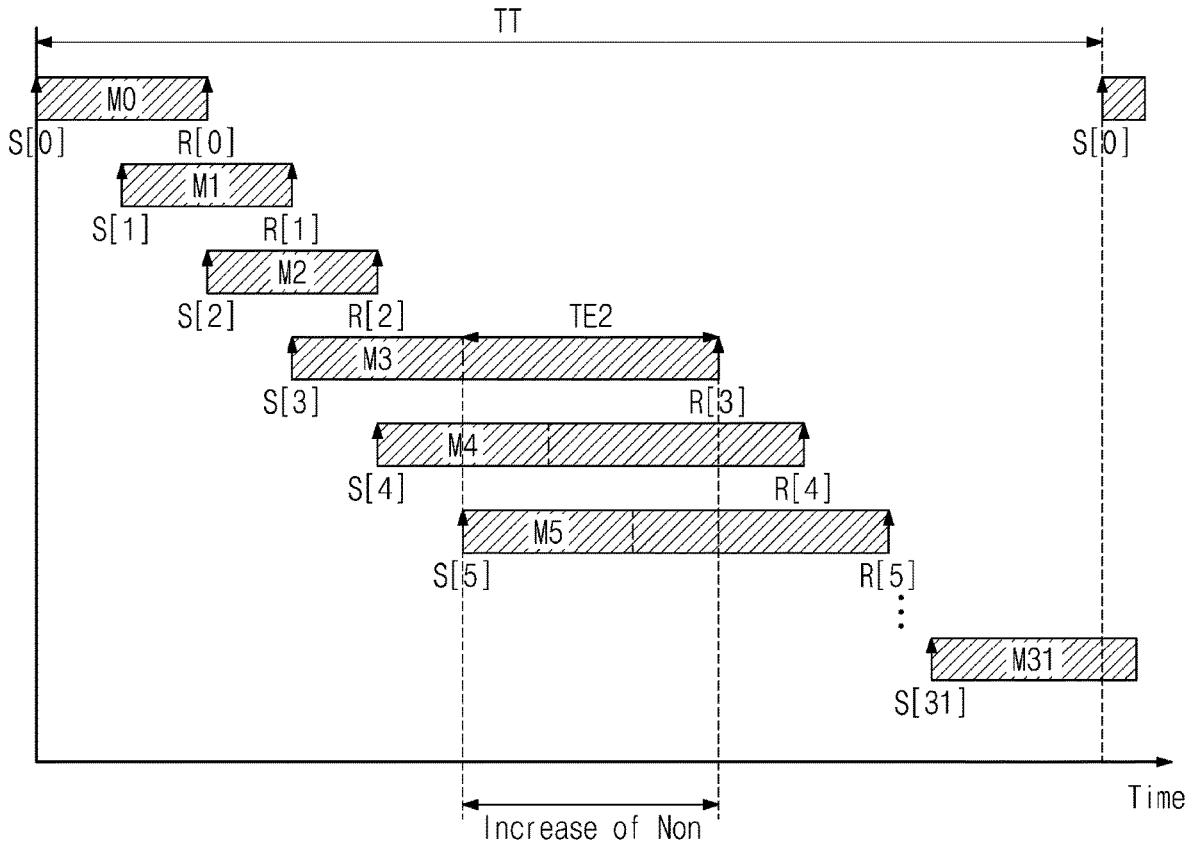

FIGS. 9 and 10 are graphs for describing how a transient detector of FIG. 1 adjusts the number of enabled switches. FIGS. 9 to 10 are diagrams for describing the number of enabled switches in a transient state. FIG. 9 is a diagram for describing an operation in which the number of enabled switches decreases when the output voltage Vo is greater than the first voltage V1. FIG. 10 is a diagram for describing an operation in which the number of enabled switches increases when the output voltage Vo is smaller than the second voltage V2.

Referring to FIG. 9, at a specific time, the output voltage Vo may be greater than the first voltage V1. In this case, the first enable signal EN1 may block a transfer of an input signal from the bias generator 110 to the first voltage-controlled oscillator 121, and the first voltage-controlled oscillator 121 may be deactivated. A set signal may not be generated until the output voltage Vo is set within the reference range.

For convenience of description, it is assumed that the output voltage Vo becomes greater than the first voltage V1, at a time point when a rising edge of the third set signal S[3] is generated in the case of the normal state. In this case, the first voltage-controlled oscillator 121 may be deactivated, and a time point when the rising edge of the third set signal S[3] is generated may be delayed as much as a transient time TE1. Accordingly, an additional turn-on of the switches M0 to M31 may be delayed during the transient time TEL In contrast, because the switches M0 to M31 are sequentially turned off during the transient time TE1, the number Non of enabled switches decreases.

During the transient time TE1 when the generation of the third set signal S[3] is delayed, the second voltage-controlled oscillator 122 may generate a rising edge of a reset signal based on a sum of the first and second input signals I1 and I2. As such, although not illustrated, a frequency of reset signals generated during a relevant time may increase. For example, a time interval from a rising edge of the fourth reset signal R[4] to when a rising edge of the fifth reset signal R[5] is generated may be smaller than a time interval from a rising edge of the third reset signal R[3] to when a rising edge of the fourth reset signal R[4] is generated. As such, the number Non of enabled switches may sharply decrease.

In the case where the output voltage Vo is set within the reference range, the first voltage-controlled oscillator 121 is activated, and a rising edge of the third set signal S[3] is generated. Assuming that the regulator 100 returns to the normal state immediately, the decreased number Non of enabled switches may be uniformly maintained. Of course, as described with reference to FIG. 8, even after the output voltage Vo is set within the reference range, the decrease of the output voltage Vo may be required until the feedback voltage Vod satisfies the reference voltage Vref. In this case, the number Non of enabled switches may decrease through the feedback loop described with reference to FIG. 1.

Referring to FIG. 10, at a specific time, the output voltage Vo may be smaller than the second voltage V2. In this case, the second enable signal EN2 may block a transfer of an input signal from the bias generator 110 to the second voltage-controlled oscillator 122, and the second voltage-controlled oscillator 122 may be deactivated. A reset signal may not be generated until the output voltage Vo is set within the reference range.

For convenience of description, it is assumed that the output voltage Vo becomes smaller than the second voltage V2, at a time point when a rising edge of the third reset signal R[3] is generated in the case of the normal state. In this case, the second voltage-controlled oscillator 122 may be deactivated, and a time point when the rising edge of the third reset signal R[3] is generated may be delayed as much as a transient time TE2. Accordingly, an additional turn-off of the switches M0 to M31 may be delayed during the transient time TE2. In contrast, because the switches M0 to M31 are sequentially turned on during the transient time TE2, the number Non of enabled switches increases.

During the transient time TE2 when the generation of the third reset signal R[3] is delayed, the first voltage-controlled oscillator 121 may generate a rising edge of a set signal based on a sum of the first and second input signals I1 and I2. As such, although not illustrated, a frequency of set signals generated during a relevant time may increase. That is, a time interval from a rising edge of the fifth set signal S[5] to when a rising edge of the sixth set signal S[6] is generated may be smaller than a time interval from a rising edge of the fourth set signal S[4] to when a rising edge of the fifth set signal S[5] is generated. As such, the number Non of enabled switches may sharply increase.

In the case where the output voltage Vo is set within the reference range, the second voltage-controlled oscillator 122 is activated, and a rising edge of the third reset signal R[3] is generated. Assuming that the regulator 100 returns to the normal state immediately, the increased number Non of enabled switches may be uniformly maintained. Of course, as described with reference to FIG. 8, even after the output voltage Vo is set within the reference range, the increase of the output voltage Vo may be required until the feedback voltage Vod satisfies the reference voltage Vref. In this case, the number Non of enabled switches may increase through the feedback loop described with reference to FIG. 1.

A regulator and an operating method thereof according to an embodiment of the inventive concept may continuously adjust the number of enabled switches without quantization, and thus, the accuracy of an output voltage may be improved.

Also, the regulator and the operating method thereof according to an embodiment of the inventive concept may adjust the output voltage by using a voltage-controlled oscillator, and thus, a ripple of the output voltage may be improved.

Also, the regulator and the operating method thereof according to an embodiment of the inventive concept may improve a transient response speed by controlling the activation of the voltage-controlled oscillator in a transient response.

While the inventive concept has been described with reference to exemplary embodiments thereof, it will be apparent to those of ordinary skill in the art that various changes and modifications may be made thereto without departing from the spirit and scope of the inventive concept as set forth in the following claims.

What is claimed is:

1. A regulator comprising:

a switch array including a plurality of switches connected in parallel and generating an output voltage based on a number of enabled switches from among the plurality of switches;

a feedback circuit generating a feedback voltage which depends on a level of the output voltage;

a first voltage-controlled oscillator generating a first signal having a first frequency which depends on a difference between a reference voltage and the feedback voltage;

a second voltage-controlled oscillator generating a second signal having a second frequency which depends on a difference between the feedback voltage and the reference voltage; and a switch driver determining a turn-on time point of each of the plurality of switches based on the first signal and determining a turn-off time point of each of the plurality of switches based on the second signal.

2. The regulator of claim 1, wherein, when the reference voltage is greater than the feedback voltage, the first frequency is greater than the second frequency, and the number of the enabled switches increases depending on a difference between the first frequency and the second frequency.

3. The regulator of claim 1, wherein, when the feedback voltage is greater than the reference voltage, the second frequency is greater than the first frequency, and the number of the enabled switches decreases depending on a difference between the second frequency and the first frequency.

4. The regulator of claim 1, wherein, when the reference voltage is equal to the feedback voltage, the first frequency and the second frequency are equal to a reference frequency, and the turn-on time point and the turn-off time point of each of the plurality of switches are repeated at the reference frequency.

5. The regulator of claim 1, wherein the first voltage-controlled oscillator generates the first signal including a plurality of set signals having different phases and respectively corresponding to the plurality of switches, wherein the second voltage-controlled oscillator generates the second signal including a plurality of reset signals having different phases and respectively corresponding to the plurality of switches, and wherein the switch driver turns on the plurality of switches respectively at different time points based on the different phases of the plurality of set signals and turns off the plurality of switches respectively at different time points based on the different phases of the plurality of reset signals.

6. The regulator of claim 5, wherein the switch driver turns on the plurality of switches respectively corresponding to the plurality of set signals in response to rising edges of the different phases of the plurality of set signals and turns off the plurality of switches respectively corresponding to the plurality of reset signals in response to rising edges of the different phases of the plurality of reset signals.

7. The regulator of claim 1, further comprising:

a transient detector deactivating the first voltage-controlled oscillator when the level of the output voltage is greater than a first voltage level and deactivating the second voltage-controlled oscillator when the level of the output voltage is smaller than a second voltage level lower than the first voltage level.

8. The regulator of claim 7, wherein, when the level of the output voltage is greater than the first voltage level, the first voltage-controlled oscillator delays generation of the first signal until the level of the output voltage is smaller than the first voltage level, and wherein the number of the enabled switches decreases while the generation of the first signal is delayed.

9. The regulator of claim 7, wherein, when the level of the output voltage is smaller than the second voltage level, the second voltage-controlled oscillator delays generation of the second signal until the level of the output voltage is greater than the second voltage level, and wherein the number of the enabled switches increases while the generation of the second signal is delayed.

10. A regulator comprising:

a switch array including a plurality of switches connected in parallel between an input terminal and an output terminal;

a feedback circuit generating a feedback voltage which depends on a voltage level of the output terminal;

a bias generator generating a first input signal based on a difference between a reference voltage and the feedback voltage and generating a second input signal based on a difference between the feedback voltage and the reference voltage;

a first voltage-controlled oscillator generating a plurality of set signals having different phases and respectively corresponding to the plurality of switches, based on the first input signal;

a second voltage-controlled oscillator generating a plurality of reset signals having different phases and respectively corresponding to the plurality of switches, based on the second input signal;

a switch driver sequentially turning on the plurality of switches based on respective phases of the plurality of set signals and sequentially turning off the plurality of switches based on respective phases of the plurality of reset signals; and a transient detector controlling a transfer of the first input signal to the second voltage-controlled oscillator and a transfer of the second input signal to the second voltage-controlled oscillator, based on the voltage level of the output terminal.

11. The regulator of claim 10, wherein the bias generator generates the first input signal of a level proportional to a difference between the reference voltage and the feedback voltage and generates the second input signal of a level proportional to a difference between the feedback voltage and the reference voltage.

12. The regulator of claim 10, wherein the first voltage-controlled oscillator includes a first ring oscillator sequentially outputting the plurality of set signals at a time interval which depends on a level of the first input signal, and wherein the second voltage-controlled oscillator includes a second ring oscillator sequentially outputting the plurality of reset signals at a time interval which depends on a level of the second input signal.

13. The regulator of claim 10, wherein, during a time when the reference voltage and the feedback voltage are equal, a time interval when each of the plurality of switches is enabled is uniformly maintained, and time intervals when the plurality of switches are enabled are equal.

14. The regulator of claim 10, wherein, during a time when the reference voltage is greater than the feedback voltage, a time interval when each of the plurality of switches is enabled on increases.

15. The regulator of claim 10, wherein, during a time when the feedback voltage is greater than the reference voltage, a time interval when each of the plurality of switches is enabled decreases.

16. The regulator of claim 10, wherein the transient detector includes:

a first comparator generating a first enable signal when the voltage level of the output terminal is smaller than a first voltage level and generating a first disable signal when the voltage level of the output terminal is greater than the first voltage level; and a second comparator generating a second enable signal when the voltage level of the output terminal is smaller than a second voltage level lower than the first voltage level and generating a second disable signal when the voltage level of the output terminal is smaller than the second voltage level, wherein the first voltage-controlled oscillator receives the first input signal based on the first enable signal, and wherein the second voltage-controlled oscillator receives the second input signal based on the second enable signal.

17. The regulator of claim 16, further comprising:

a network circuit electrically connecting the bias generator and the first voltage-controlled oscillator based on the first enable signal, electrically disconnecting the bias generator from the first voltage-controlled oscillator based on the first disable signal, electrically connecting the bias generator and the second voltage-controlled oscillator based on the second enable signal, and electrically disconnecting the bias generator from the second voltage-controlled oscillator based on the second disable signal.

18. An operating method of a regulator, comprising:

generating an output voltage based on a number of enabled switches from among a plurality of switches included in a switch array;

generating a feedback voltage which depends on a level of the output voltage;

generating a plurality of set signals having a first frequency, which depends on a difference between a reference voltage and the feedback voltage, and having different phases;

generating a plurality of reset signals having a second frequency, which depends on a difference between the feedback voltage and the reference voltage, and having different phases;

sequentially turning on the plurality of switches, depending on respective phases of the plurality of set signals; and sequentially turning off the plurality of switches, depending on respective phases of the plurality of reset signals.

19. The operating method of claim 18, wherein, when the reference voltage is greater than the feedback voltage, the first frequency is greater than the second frequency, and a number of enabled switches from among the plurality of switches increases depending on a difference between the first frequency and the second frequency, and wherein, when the feedback voltage is greater than the reference voltage, the second frequency is greater than the first frequency, and the number of the enabled switches decreases depending on a difference between the second frequency and the first frequency.

20. The operating method of claim 18, further comprising:

delaying generation of the plurality of set signals until the level of the output voltage is smaller than a first voltage level, when the level of the output voltage is greater than the first voltage level; and delaying generation of the plurality of reset signals until the level of the output voltage is greater than a second voltage level, when the level of the output voltage is smaller than the second voltage level.

* * * * *